US012538988B2

(12) United States Patent
Alletto, Jr.

(10) Patent No.: US 12,538,988 B2
(45) Date of Patent: Feb. 3, 2026

(54) MATTRESS WITH RAILS AND METHOD OF USE

(71) Applicant: BEDGEAR, LLC, Farmingdale, NY (US)

(72) Inventor: Eugene Alletto, Jr., Glen Head, NY (US)

(73) Assignee: Bedgear, LLC, Farmingdale, NY (US)

( * ) Notice: Subject to any disclaimer, the term of this patent is extended or adjusted under 35 U.S.C. 154(b) by 99 days.

(21) Appl. No.: 17/187,236

(22) Filed: Feb. 26, 2021

(65) Prior Publication Data

US 2021/0177161 A1 Jun. 17, 2021

Related U.S. Application Data

(63) Continuation of application No. 16/177,975, filed on Nov. 1, 2018, now Pat. No. 11,304,538.
(Continued)

(51) Int. Cl.

| | |
|---|---|
| ***A47D 15/00*** | (2006.01) |
| ***A47C 21/08*** | (2006.01) |
| ***A47C 27/05*** | (2006.01) |
| ***A47C 27/06*** | (2006.01) |
| ***A47C 27/14*** | (2006.01) |
| ***A47C 27/20*** | (2006.01) |

(52) U.S. Cl.
CPC ..... *A47D 15/001* (2013.01); *A47C 21/08* (2013.01); *A47C 27/05* (2013.01); *A47C 27/066* (2013.01); *A47C 27/142* (2013.01); *A47C 27/146* (2013.01); *A47C 27/20* (2013.01); *A47C 27/14* (2013.01)

(58) Field of Classification Search
CPC ..... A47C 21/08; A47C 27/066; A47C 27/142; A47C 27/001; A47C 21/00; A47C 31/123; A47C 31/10; A47C 27/146; A47D 15/001; A47D 15/008; A47D 7/00; A47D 11/005; A47D 15/00; A47D 13/00; A61G 7/0507; A47G 9/02; A47G 9/00
USPC ... 5/424, 425, 732, 739, 655, 717, 485, 482, 5/427
See application file for complete search history.

(56) References Cited

U.S. PATENT DOCUMENTS 3,378,862 A 4/1968 Skinner
4,286,344 A * 9/1981 Ikeda ..... A47C 21/08 5/717

(Continued)

FOREIGN PATENT DOCUMENTS

CN 202354947 U 8/2012
CN 103054380 A 4/2013

(Continued)

OTHER PUBLICATIONS

"Rail." Merriam-Webster, Merriam-Webster, www.merriam-webster.com/dictionary/rail.*

(Continued)

*Primary Examiner* — Madison Emanski
(74) *Attorney, Agent, or Firm* — Sorell, Lenna & Schmidt, LLP

(57) ABSTRACT

A mattress assembly includes a cover having a pocket. A mattress is positioned within the pocket. The mattress includes opposite first and second sides, the first side having a cavity. An insert is positioned within the cavity. Methods of use are disclosed.

15 Claims, 6 Drawing Sheets

Related U.S. Application Data

(60) Provisional application No. 62/580,069, filed on Nov. 1, 2017.

(56) References Cited

U.S. PATENT DOCUMENTS

| | | | | |
|---|---|---|---|---|
| 4,607,402 | A * | 8/1986 | Pollard | A47D 15/008 D6/333 |
| 4,872,228 | A * | 10/1989 | Bishop | A47D 15/008 5/513 |
| 5,699,569 | A | 12/1997 | Schwarz-Zoehrer | |
| 5,963,998 | A | 10/1999 | Carew et al. | |
| 6,848,130 | B1 * | 2/2005 | Wilson | A47C 21/08 5/427 |
| 6,971,132 | B2 | 12/2005 | Feinsod | |
| 7,107,635 | B2 * | 9/2006 | Henry | A47G 9/02 5/482 |
| 7,165,282 | B2 | 1/2007 | Watson et al. | |
| 7,631,381 | B2 | 12/2009 | Flippin et al. | |
| 7,904,977 | B1 * | 3/2011 | Singh | A47G 9/0246 5/497 |
| 8,661,588 | B1 * | 3/2014 | Leach | A47D 15/001 5/655 |
| 2005/0138730 | A1 * | 6/2005 | Henry | A47G 9/02 5/482 |
| 2012/0011651 | A1 * | 1/2012 | Moss | A47C 21/08 5/424 |
| 2013/0145555 | A1 | 6/2013 | Hargreaves et al. | |
| 2013/0219629 | A1 | 8/2013 | Dilley | |
| 2013/0291312 | A1 | 11/2013 | Bell, Jr. | |
| 2015/0245717 | A1 * | 9/2015 | Edmondson | A47C 21/08 5/425 |

FOREIGN PATENT DOCUMENTS

| | | | |
|---|---|---|---|
| EP | 1329177 | A2 | 7/2003 |
| WO | 2014125472 | A1 | 8/2014 |
| WO | 2016171692 | A1 | 10/2016 |
| WO | 2016171692 | A2 | 10/2016 |

OTHER PUBLICATIONS

Hiccapop Toddler Bed Rail Bumper, Amazon, Date First Available Jul. 8, 2016, www.amazon.com/dp/B01DTBKPWO?ref_=cm_sw_r_cp_ud_dp_1TS2KRZJ447MZ5XGFMWK&th=1 (Year: 2016).*

"On." Merriam-Webster, Merriam-Webster, www.merriam-webster.com/dictionary/on. (Year 2017).*

"Stretchable." Merriam-Webster, Merriam-Webster, www.merriam-webster.com/thesaurus/stretchable (Year 2016).*

"Elastic." Merriam-Webster, Merriam-Webster, www.merriam-webster.com/dictionary/elastic. (Year 2017).*

International Search Report and Written Opinion of the International Searching Authority, European Patent Office, PCT/US2018/058697, mailed Dec. 21, 2018.

Canadian Office Action, Canadian Intellectual Property Office, Canadian Appl No. 3081576, 4 pgs, dtd Jan. 10, 2024.

* cited by examiner

MATTRESS WITH RAILS AND METHOD OF USE

CROSS-REFERENCE TO RELATED APPLICATIONS

This application is a continuation application of U.S. patent application Ser. No. 16/177,975, filed on Nov. 1, 2018, which claims priority to U.S. Provisional Patent Application 62/580,069 filed on Nov. 1, 2017, which is expressly incorporated by reference herein, in its entirety.

TECHNICAL FIELD

The present disclosure generally relates to mattresses, and more particularly to mattress assemblies that include a dual-side mattress having two different comfort choices.

BACKGROUND

Sleep is critical for people to feel and perform their best, in every aspect of their lives. Sleep is an essential path to better health and reaching personal goals. Indeed, sleep affects everything from the ability to commit new information to memory to weight gain. It is therefore essential for people to use bedding that suit both their personal sleep preference and body type in order to achieve comfortable, restful sleep.

Toddlers often require firmer mattresses than older children. In order to prevent having to purchase a new mattress when children become older, some mattresses include a first side having a firmness that is suited for toddlers and a second side having a firmness that is suited for older children. However, such mattresses lack any structure, such as, for example, rails that can help prevent younger children from rolling out of bed. Furthermore, such mattresses typically include a cover that is sewn onto the mattress, thus requiring that the cover be flipped when the mattress is flipped. This disclosure describes an improvement over these prior art technologies.

SUMMARY

In one embodiment, in accordance with the principles of the present disclosure, a mattress assembly comprises a cover including a pocket. A mattress is positioned within the pocket. The mattress comprises opposite first and second sides, the first side comprising a cavity. An insert is positioned within the cavity.

BRIEF DESCRIPTION OF THE DRAWINGS

The present disclosure will become more readily apparent from the specific description accompanied by the following drawings, in which.

DETAILED DESCRIPTION

Figure 1:
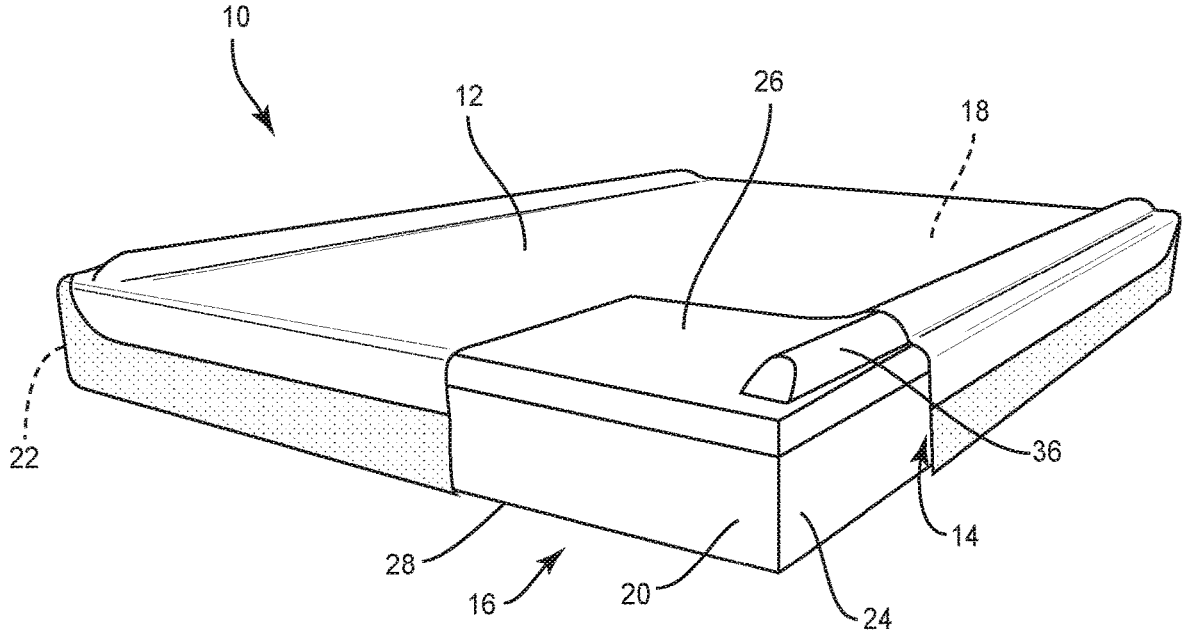
FIG. 1 is a perspective view, in part phantom, of one embodiment of a mattress assembly in accordance with the present principles of the present disclosure.
Figure 2:
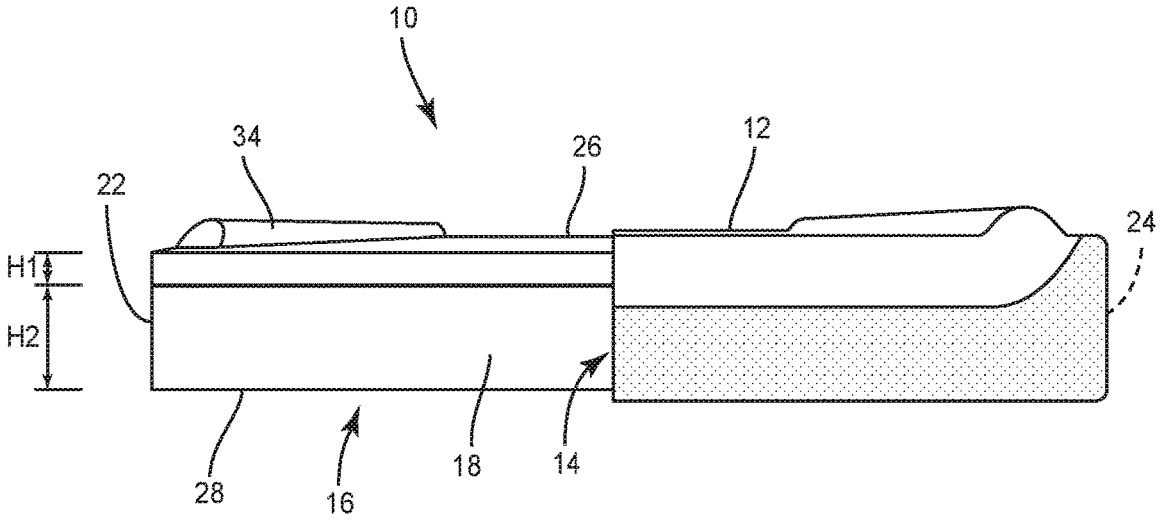
FIG. 2 is a side view, in part phantom, of the mattress assembly shown in FIG. 1.

The exemplary embodiments are discussed in terms of mattresses, such as, for example, mattress assemblies that include a dual-side mattress having two different comfort choices. The present disclosure may be understood more readily by reference to the following detailed description of the disclosure. It is to be understood that this disclosure is not limited to the specific devices, methods, conditions or parameters described and/or shown herein, and that the terminology used herein is for the purpose of describing particular embodiments by way of example only and is not intended to be limiting of the claimed disclosure.

Also, as used in the specification and including the appended claims, the singular forms "a," "an," and "the" include the plural, and reference to a particular numerical value includes at least that particular value, unless the context clearly dictates otherwise. Ranges may be expressed herein as from "about" or "approximately" one particular value and/or to "about" or "approximately" another particular value. When such a range is expressed, another embodiment includes from the one particular value and/or to the other particular value. Similarly, when values are expressed as approximations, by use of the antecedent "about," it will be understood that the particular value forms another embodiment. It is also understood that all spatial references, such as, for example, horizontal, vertical, top, upper, lower, bottom, left and right, are for illustrative purposes only and can be varied within the scope of the disclosure. For example, the references "upper" and "lower" are relative and used only in the context to the other, and are not necessarily "superior" and "inferior".

The following discussion includes a description of a mattress assembly 10. Alternate embodiments are also disclosed. Reference will now be made in detail to the exemplary embodiments of the present disclosure.

The components of mattress assembly 10 can be fabricated from materials including metals, synthetic polymers, ceramics and/or their composites, depending on the particular application and/or preference. For example, the components of mattress assembly 10, individually or collectively, can be fabricated from materials such as stainless steel alloys, aluminum, commercially pure titanium, titanium alloys, Grade 5 titanium, super-elastic titanium alloys, cobalt-chrome alloys, stainless steel alloys, superelastic metallic alloys (e.g., Nitinol, super elasto-plastic metals, such as GUM METAL® manufactured by Toyota Material Incorporated of Japan), ceramics, thermoplastics such as polyaryletherketone (PAEK) including polyetheretherketone (PEEK), polyetherketoneketone (PEKK) and polyetherketone (PEK), carbon-PEEK composites, PEEK-$BaSO_4$ polymeric rubbers, polyethylene terephthalate (PET), fabric, silicone, polyurethane, silicone-polyurethane copolymers, polymeric rubbers, polyolefin rubbers, hydrogels, semi-rigid and rigid materials, elastomers, rubbers, thermoplastic elastomers, thermoset elastomers, elastomeric composites, rigid polymers including polyphenylene, polyamide, polyimide, polyetherimide, polyethylene, and epoxy. Various components of mattress assembly 10 may have material composites, including the above materials, to achieve various desired characteristics such as strength, rigidity, elasticity, compliance, mechanical performance, durability and radiolucency or imaging preference. The components of mattress assembly 10, individually or collectively, may also be fabricated from a heterogeneous material such as a combination of two or more of the above-described materials. The components of mattress assembly 10 may be monolithically formed, integrally connected or include fastening elements and/or instruments, as described herein.

In some embodiments, mattress assembly 10 includes a dual-side mattress of two different comfort choices. For example, the mattress can include a firmer side for toddlers and a softer side for tweens. The mattress can be flipped as the child grows to prevent the need to buy another bed for approximately 10-11 years. For example, the same mattress can be used from when the child is 2 or 3 years old until the child is 12 or 13 years old.

In some embodiments, one side of the mattress, such as, for example, the firmer side of the mattress includes pockets in the underlying fabric surface which hold removable foam rails, which when in use, keep the child from rolling off the bed at night. That is, the foam rails are like bolsters often used to keep a child from rolling off the bed. As the child grows, the rails are removed, and the stretch pockets in the mattress just return to a substantially flat configuration thereby making a relatively flat surface of the mattress.

In some embodiments, the mattress assembly includes a zip-off surface, such as, for example, a cover that can be removed to expose the pockets. The rails can be inserted into the pockets when the pockets are exposed. The mattress can then be inserted into the cover to maintain the rails within the pockets. Likewise, the mattress can be removed from the cover to remove the rails from the pockets. The mattress can then be inserted into the cover without the rails being positioned within the pockets. This configuration allows the mattress to be flipped after the mattress is removed from the cover and for the mattress to be reinserted into the cover after the mattress is flipped.

Mattress assembly 10 includes a cover 12 that defines a pocket 14. In some embodiments, cover 12 includes only one pocket, such as, for example, pocket 14. In some embodiments, cover 12 includes a plurality of discrete pockets. In some embodiments, cover 12 includes a fastener, such as, for example, a zipper to provide access to pocket 14.

Mattress assembly 10 includes a mattress 16 that is configured to be positioned within pocket 14. Mattress 16 includes opposite top and bottom surfaces 18, 20 and opposite left and right surfaces 22, 24 that each extend from top surface 18 to bottom surface 20. Mattress 16 has a maximum height defined by the distance from top surface 18 to bottom surface 20 and a maximum width defined by the distance from left surface 22 to right surface 24. Mattress 16 includes opposite first and second sides 26, 28 that each include surfaces 18, 20, 22, 24. First side 26 has a first firmness and second side 28 has a second firmness. In some embodiments, the second firmness is different than the first firmness. In some embodiments, the second firmness is less than the first firmness. In some embodiments, the second firmness greater than the first firmness. In some embodiments, first side 26 comprises a first material to impart first side 26 with the first firmness and second side 28 comprises a second material to impart second side 28 with the second firmness. In some embodiments, the first material is the same as the second material. In some embodiments, the first material is different than the second material. First side 26 has a thickness t1 and second side 28 has a thickness t2. In some embodiments, thickness t1 is the same as thickness t2. In some embodiments, thickness t1 is different than thickness t2. In some embodiments, thickness t1 is less than thickness t2. In some embodiments, thickness t1 is greater than thickness t2.

First side of the mattress 26 includes a first cavity 30 adjacent to left surface 22 and a second cavity 32 adjacent to right surface 24. Cavities 30, 32 each extend into an upper surface 26*a* of first side 26. First cavity 30 is spaced apart from second cavity 32. First cavity 30 is positioned inwardly of left surface 22 and second cavity 32 is positioned inwardly of right surface 24 such that cavities 30, 32 are each positioned between left surface 22 and right surface 24. However, it is envisioned that first cavity 30 may extend into and/or through left surface 22 and second cavity 32 may extend into and/or through right surface 24.

In some embodiments, cavities 30, 32 each have a uniform diameter along the entire length of cavities 30, 32. In some embodiments, first cavity 30 extends parallel to second cavity 32. In some embodiments, cavities 30, 32 are each positioned inwardly of top surface 18 and bottom surface 20 such that cavities 30, 32 are each positioned between top surface 18 and bottom surface 20. In some embodiments, cavities 30, 32 each extend through top surface 18 and/or bottom surface 20. In some embodiments, cavity 30 and/or cavity 32 may have various cross section configurations, such as, for example, oval, oblong, triangular, rectangular, square, polygonal, irregular, uniform, non-uniform, variable, tubular and/or tapered. In some embodiments, cavity 30 may be disposed at alternate orientations, relative to cavity 32, such as, for example, transverse and/or other angular orientations such as acute or obtuse and/or may be offset or staggered.

Figure 3:
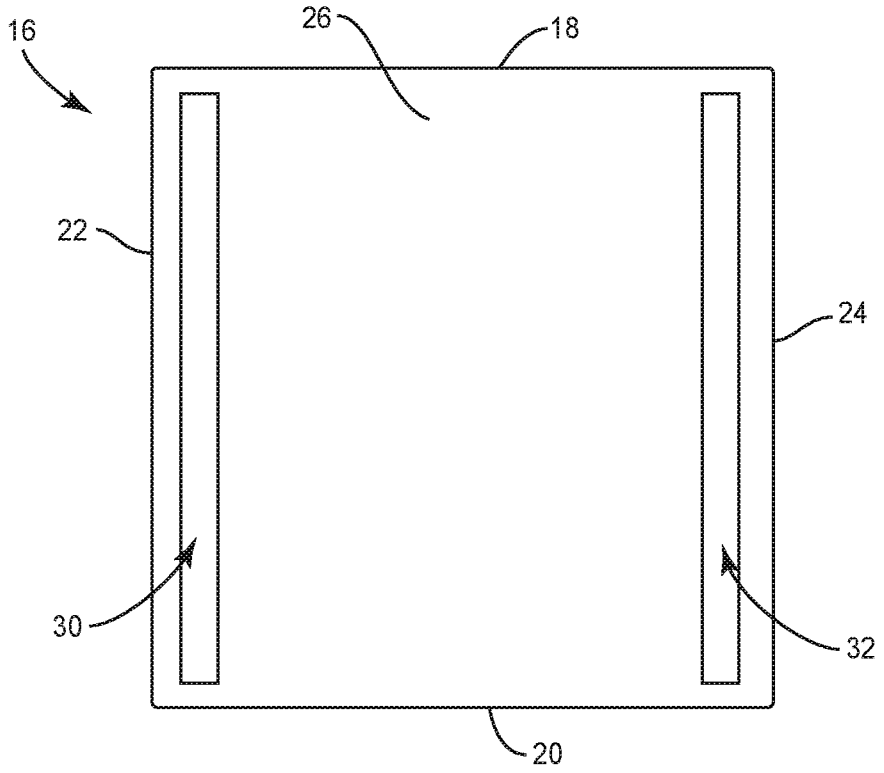
FIG. 3 is a top view of a component of the mattress assembly shown in FIG. 1.
Figure 4:
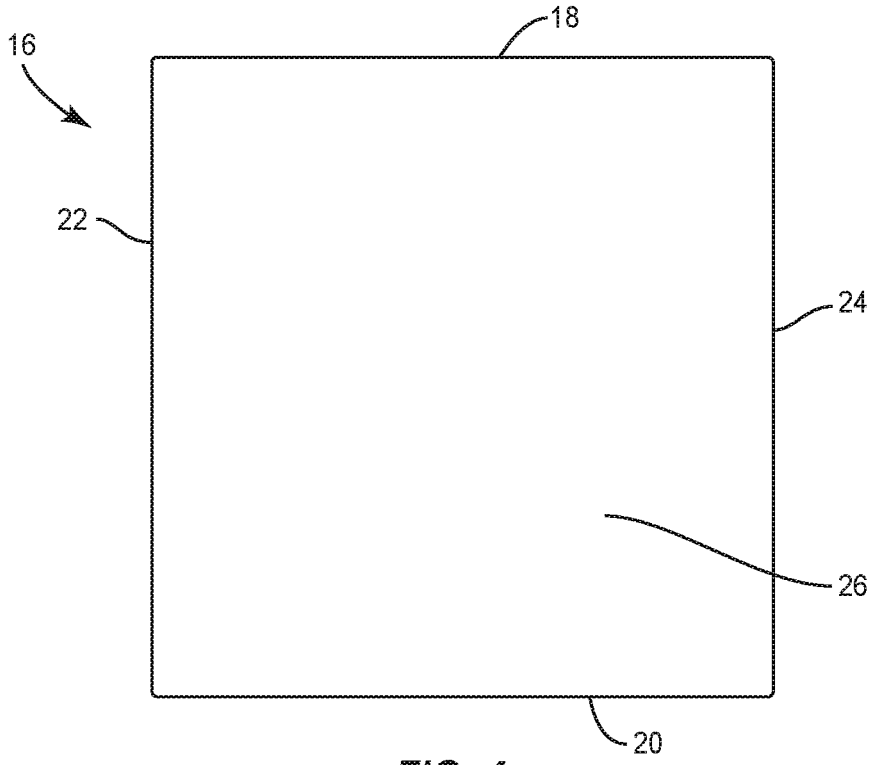
FIG. 4 is a top view of a component of the mattress assembly shown in FIG. 1.

Mattress 16 is movable between an unstretched configuration in which first side 26 includes cavities 30, 32 (FIG. 3) and a stretched configuration in which first side 26 is completely flat (FIG. 4). That is, cavities 30, 32 are visible when mattress 16 is in the unstretched configuration and are not visible when mattress 16 is in the stretched configuration. When mattress 16 is in the stretched configuration, first side 26 is completely planar from top surface 18 to bottom surface 20 and from left surface 22 to right surface 24. As such, first side 26 is free of any indents, recesses or cavities when mattress 16 is in the stretched configuration.

Cavity 30 is configured for disposal of a rail, such as, for example, a first insert 34 and cavity 32 is configured for disposal of a rail, such as, for example, a second insert 36. First insert 34 is removably positioned within cavity 30 and second insert 36 is removably positioned within cavity 32. When mattress 16 is positioned in pocket 14, cover 12 maintains inserts 34, 36 in cavities 30, 32 such that inserts 34, 36 are fixed relative to mattress 16, as discussed herein.

Figure 5:
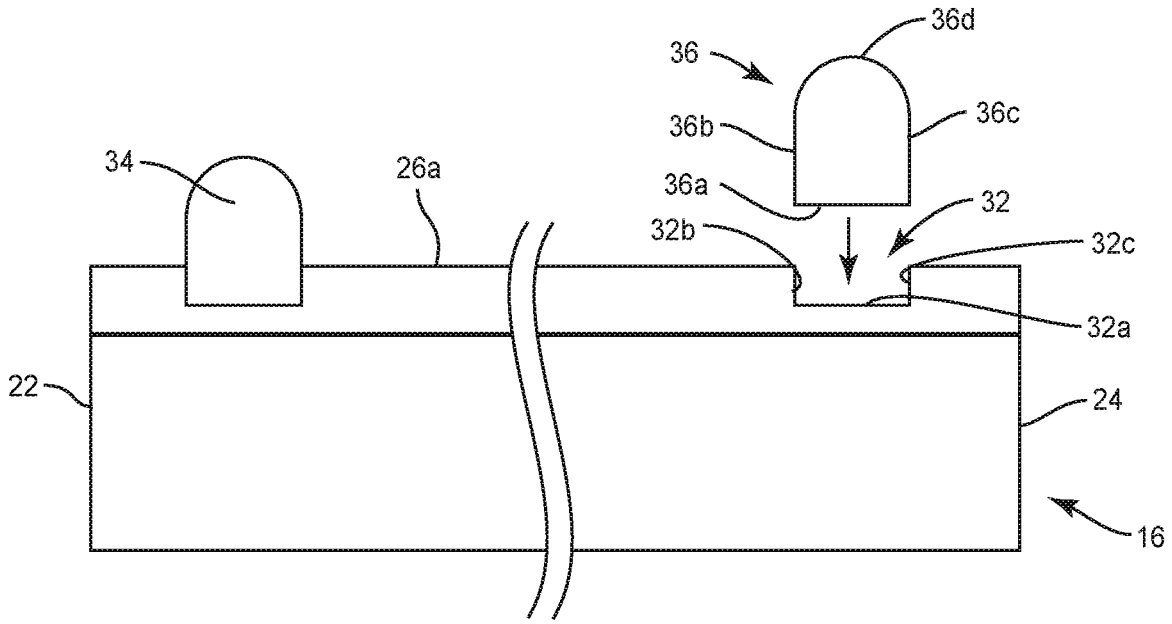
FIG. 5 is a side, cross sectional view of one embodiment of components of the mattress assembly shown in FIG. 1, in accordance with the present principles of the present disclosure.

In some embodiments, inserts 34, 36 may each have a configuration that prevents inserts 34, 36 from moving relative to mattress 16. For example, in one embodiment, shown in FIGS. 5 and 6, first insert 34 includes a planar bottom surface 34*a* that extends between planar side surfaces 34*b*, 34*c*. Side surfaces 34*b*, 34*c* extend transverse to bottom surface 34*a*. In some embodiments, side surfaces 34*b*, 34*c* extend perpendicular to bottom surface 34*a*. First insert 34 includes an arcuate top surface 34*d*. Top surface 34*d* is convexly curved. In some embodiments, top surface 34*d* is continuously curved from side surface 34*b* to side surface 34*c*. In some embodiments, top surface 34*d* has a continuous radius of curvature from side surface 34*b* to side surface 34*c*. When first insert 34 is positioned within first cavity 30, bottom surface 34*a* directly engages a surface 30*a* of mattress 16 and side surfaces 34*b*, 34*c* directly engage surfaces 30*b*, 30*c* of mattress 16 to prevent first insert 34 from moving relative to mattress 16. Second insert 36 includes a planar bottom surface 36*a* that extends between planar side surfaces 36*b*, 36*c*. Side surfaces 36*b*, 36*c* extend transverse to bottom surface 36*a*. In some embodiments, side surfaces 36*b*, 36*c* extend perpendicular to bottom surface 36*a*. First insert 36 includes an arcuate top surface 36*d*. Top surface 36*d* is convexly curved. In some embodiments, top surface 36*d* is continuously curved from side surface 36*b* to side surface 36*c*. In some embodiments, top surface 36*d* has a continuous radius of curvature from side surface 36*b* to side surface 36*c*. When first insert 36 is positioned within first cavity 32, bottom surface 36*a* directly engages a surface 32*a* of mattress 16 and side surfaces 36*b*, 36*c* directly engage surfaces 32*b*, 32*c* of mattress 16 to prevent first insert 36 from moving relative to mattress 16.

Figure 6:
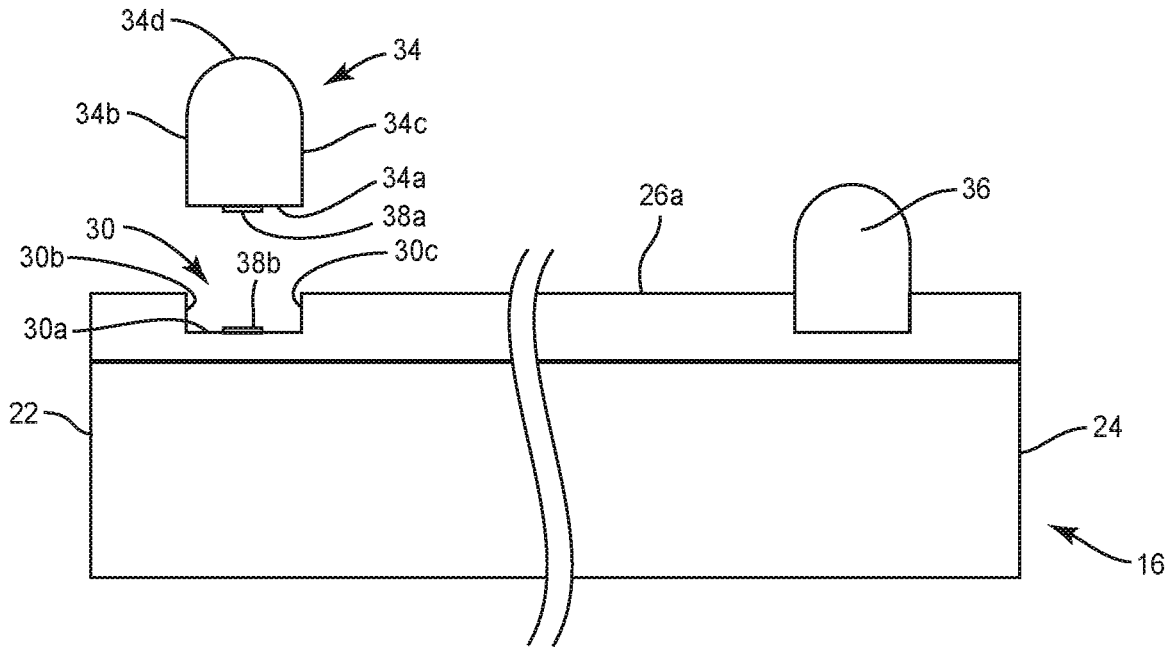
FIG. 6 is a side, cross sectional view of one embodiment of components of the mattress assembly shown in FIG. 1, in accordance with the present principles of the present disclosure.

In one embodiment, shown in FIG. 6, inserts 34, 36 may be coupled to mattress 16 using a fastener, such as, for example, a hook and loop fastener (Velcro®). A first portion 38*a* of the hook and loop fastener may be applied to bottom surface 34*a* of first insert 34 and a second portion 38*b* of the hook and loop fastener may be applied to surface 30*a* of mattress 16 such that first portion 38*a* directly engages second portion 38*b* when first insert 34 is positioned within first cavity 30 to maintain first insert 34 within first cavity 30. Likewise, first portion 38*a* of the hook and loop fastener may be applied to bottom surface 36*a* of first insert 36 and second portion 38*b* of the hook and loop fastener may be applied to surface 32*a* of mattress 16 such that first portion 38*a* directly engages second portion 38*b* when first insert 36 is positioned within second cavity 32 to maintain second insert 36 within second cavity 32.

Figure 7:
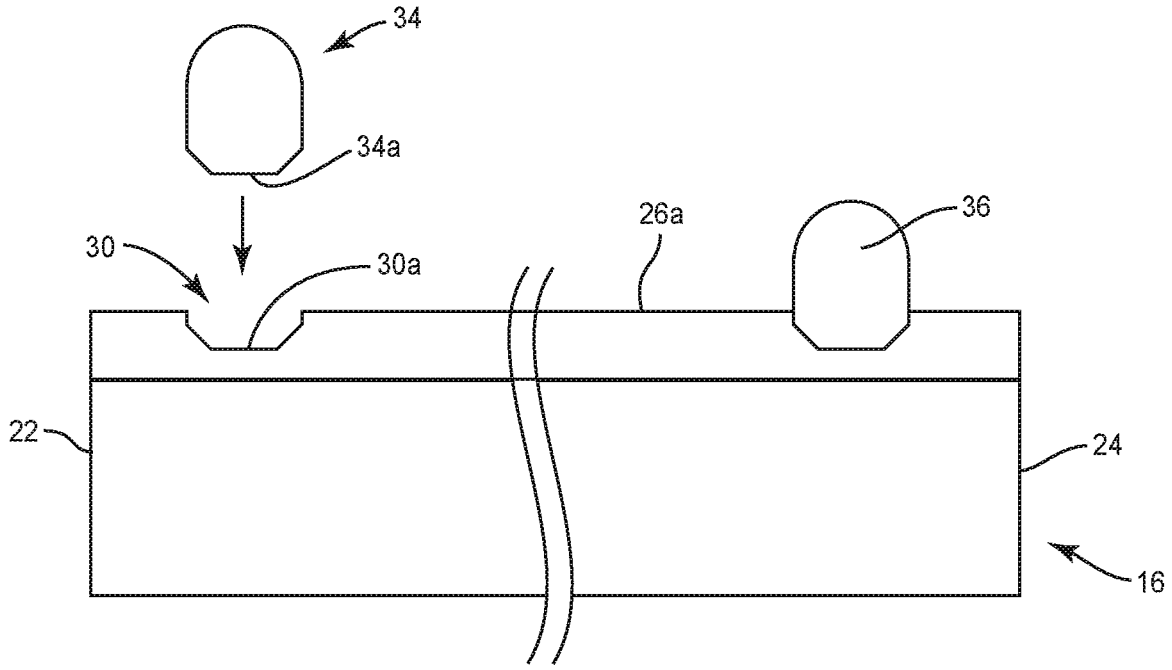
FIG. 7 is a side, cross sectional view of one embodiment of components of the mattress assembly shown in FIG. 1, in accordance with the present principles of the present disclosure.
Figure 8:
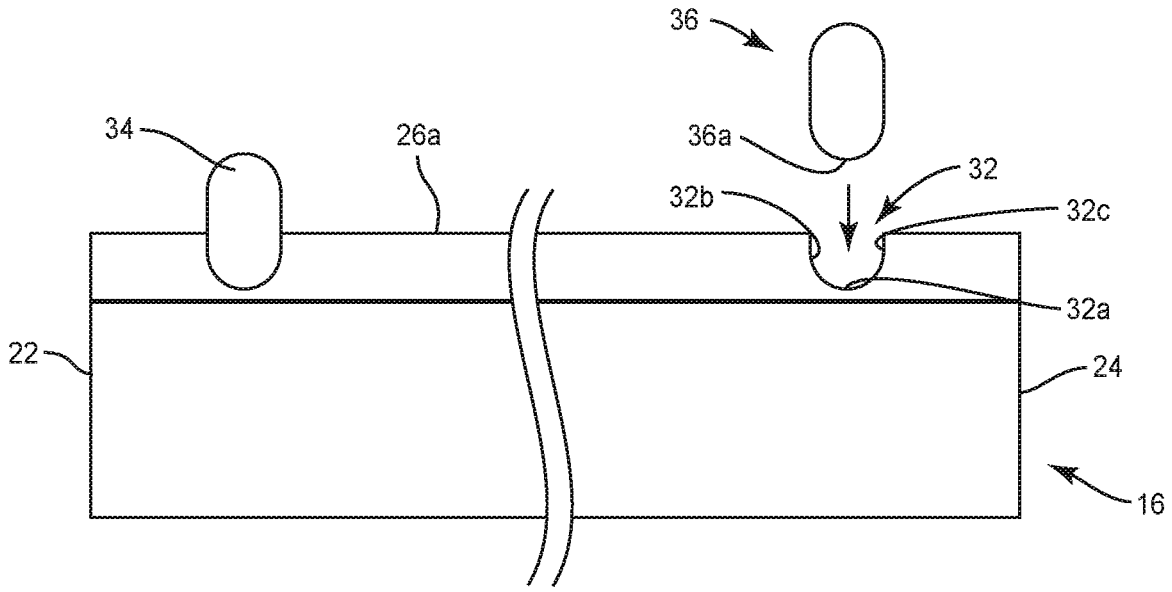
FIG. 8 is a side, cross sectional view of one embodiment of components of the mattress assembly shown in FIG. 1, in accordance with the present principles of the present disclosure.

It is envisioned that inserts 34, 36 and cavities 30, 32 may be variously configured to maintain inserts 34, 36 within cavities 30, 32. For example, in one embodiment, shown in FIG. 7, bottom surfaces 34*a*, 36*a* of inserts 34, 36 each have a polygonal configuration that is configured to mate with a polygonal configuration of surfaces 30*a*, 32*a* to prevent inserts 34, 36 from moving within cavities 30, 32. In one embodiment, shown in FIG. 8, bottom surfaces 34*a*, 36*a* of inserts 34, 36 each have an arcuate configuration that is configured to mate with an arcuate configuration of surfaces 30*a*, 32*a* to prevent inserts 34, 36 from moving within cavities 30, 32. In such embodiments, bottom surface 34*a* is continuously curved from side surface 34*b* to side surface 34*c*. In some embodiments, bottom surface 34*a* has a continuous radius of curvature from side surface 34*b* to side surface 34*c*. Surface 30*a* is continuously curved from surface 30*b* to surface 30*c*. In some embodiments, surface 30*a* has a continuous radius of curvature from surface 30*b* to surface 30*c*. Likewise, bottom surface 36*a* is continuously curved from side surface 36*b* to side surface 36*c*. In some embodiments, bottom surface 36*a* has a continuous radius of curvature from side surface 36*b* to side surface 36*c*. Surface 32*a* is continuously curved from surface 32*b* to surface 32*c*. In some embodiments, surface 32*a* has a continuous radius of curvature from surface 32*b* to surface 32*c*.

When inserts 34, 36 are positioned within cavities 30, 32, top surfaces 34*d*, 36*d* of inserts 34, 36 extends above upper surface 26*a* of first side 26 such that top surfaces 34*d*, 36*d* are superior to upper surface 26*a*. Cover 12 conforms to the portions of inserts 34 and 36 that extend above the surface of the mattress resulting in the rails. This configuration allows inserts 34, 36 to act as rails that may prevent a sleeper from unintentionally rolling off mattress assembly 10. That is, inserts 34, 36 project outwardly from upper surface 26*a* such that the sleeper would have to roll over at least one of inserts 34, 36 in order to roll off of mattress assembly 10.

In operation and use, insert 34 is positioned within cavity 30 and insert 36 is positioned within cavity 32, as discussed herein. Mattress 16 is then positioned within pocket 14 of cover 12 with first side 26 facing upward such that cover 12 directly engages upper surface 26*a* of first side 26 and top surfaces 34*d*, 36*d* of inserts 34, 36 to maintain inserts 34, 36 within cavities 30, 32. A sleeper may then lay on first side 26 between inserts 34, 36 such that inserts 34, 36 prevent the sleeper from unintentionally rolling off mattress 16. Should the sleeper desire a firmness that is different than the firmness of first side 26, mattress 16 may be removed from cover 12 and flipped such that second side 28 faces upward. Mattress 16 is then positioned within pocket 14 of cover 12. The sleeper may then lay on second side 28. In some embodiments, mattress 16 may be removed from cover 12 without flipping mattress 16 such that first side 26 still faces upward. Inserts 34, 36 may then be removed from cavities 30, 32 and mattress 16 positioned within pocket 14 of cover 12.

In some embodiments, first side 26 of the mattress is completely planar when mattress 26 is in both the unstretched and stretched configurations. That is, first side 26 does not include any recesses or cavities, such as, for example, cavities 30, 32. In such embodiments, the mattress is encased by cover 12 that has at least two pockets 44, 46 attached to and/or directly sewn into the surface of cover 12. The pockets are configured to receive inserts 34, 36. Once inserts 34 and 36 are positioned within pockets 44 and 46, two rails are created on the surface of the mattress 26 thereby preventing a child lying on the mattress from rolling off the mattress, as discussed above. In the alternative, inserts 34, 36 may be removably attached directly to the surface of cover 12 using a fastening system such as, for example, a hook and loop fastener (Velcro®), a zipper or snaps. When mattress 16 is positioned within pocket 14 of cover 12, cover 12 directly engages inserts 34 and 36 to prevent inserts 34, 36 from moving relative to mattress 16.

Figure 9:
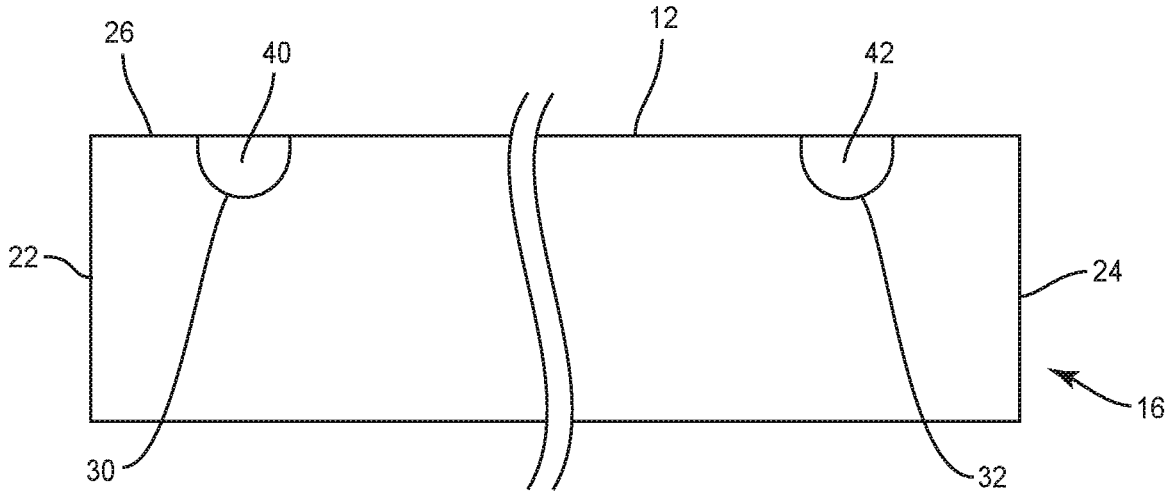
FIG. 9 is a side, cross sectional view of one embodiment of a component of the mattress assembly shown in FIG. 1, in accordance with the present principles of the present disclosure.

In some embodiments, cover 12 includes spaced apart members 40, 42 that are configured for disposal in cavities 30, 32 when inserts 34, 36 are not positioned within cavities 30, 32, as shown in FIG. 9. That is, members 40, 42 completely fill cavities 30, 32 when inserts 34, 36 are not positioned within cavities 30, 32. As such, mattress assembly 10 is completely planar from left surface 22 to right surface 24 along an entire length of mattress assembly 10 to allow a sleeper to lay upon first side 26 even when inserts 34, 36 are not positioned within cavities 30, 32.

Figure 10:
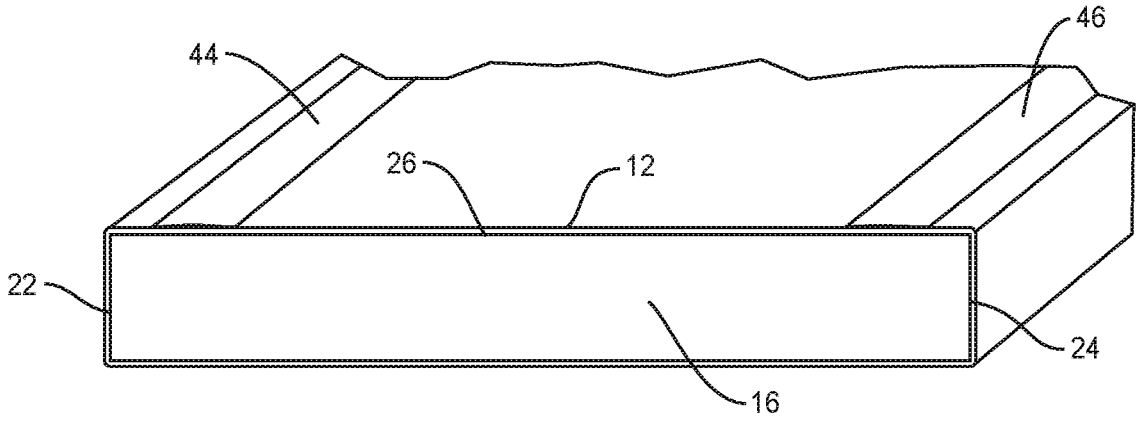
FIG. 10 is a cross section view of one embodiment of a component of the mattress assembly shown in FIG. 1, in accordance with the present principles of the present disclosure.
Figure 11:
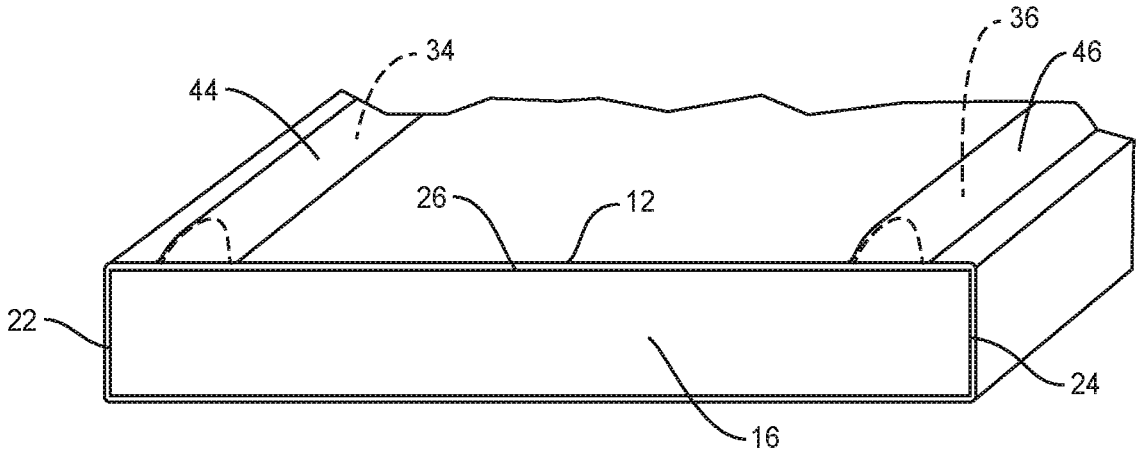
FIG. 11 is a cross section view of the mattress assembly shown in FIG. 10.

In some embodiments, first side 26 is completely planar when mattress 16 is in both the unstretched and stretched configurations and cover 12 includes spaced apart pockets 44, 46, as shown in FIGS. 10 and 11. Pockets 44, 46 are each configured for disposal of one of inserts 34, 36. It is envisioned that cover 12 may be used with or without inserts 34, 36 positioned within pockets 44, 46. For example, cover 12 can be positioned on mattress 16 such that pockets 44, 46 engage first side 26 without inserts 34, 36 positioned within pockets 44, 46. Cover 12 can be made of a stretchable material, such as, for example, spandex, to allow cover 12 to be stretched over mattress 16 such that first side 26 and the portion of cover 12 that engages first side 26 are completely planar, as shown in FIG. 10. Where rails are desired to prevent a child from falling out of bed, for example, inserts 34, 36 may be positioned within pockets 44, 46 and cover 12 can be positioned on mattress 16 such that pockets 44, 46 engage first side 26, as shown in FIG. 11.

In some embodiments, cover 12 comprises an elastic material. In some embodiments, pockets 44, 46 are positioned on an inner surface of cover 12 such that pockets 44, 46 directly engage first side 26 when cover 12 is positioned over mattress 16. In some embodiments, pockets 44, 46 are positioned on an outer surface of cover 12 such that pockets 44, 46 are spaced apart from first side 26 when cover 12 is positioned over mattress 16. In some embodiments, at least one of pockets 44, 46 includes a zipper to allow inserts 34, 36 to be removed and/or inserted from/into pockets 44, 46. In some embodiments, pockets 44, 46 extend an entire length of cover 12.

In some embodiments, pockets 44, 46 are positioned between opposite top and bottom surfaces of cover 12 such that pockets 44, 46 do not extend the entire length of cover 12. In some embodiments, mattress 16 includes cavities 30, 32. In some embodiments, mattress 16 is a standard mattress that does not include cavities 30, 32.

It will be understood that various modifications may be made to the embodiments disclosed herein. For example, features of any one embodiment can be combined with features of any other embodiment. Therefore, the above description should not be construed as limiting, but merely as exemplification of the various embodiments. Those skilled in the art will envision other modifications within the scope and spirit of the claims appended hereto.

What is claimed is:

1. An article of bedding, comprising:

a cover configured to be attached to a mattress having a sleep surface with opposite proximal and distal edges and opposite side edges each extending from the proximal edge to the distal edge; and at least one pocket coupled to the cover such that the cover is positioned on the at least one pocket and an entirety of the at least one pocket is positioned inwardly from the proximal and side edges, the at least one pocket being flush with the distal edge, the at least one pocket extending a length of the cover, the at least one pocket comprising opposite first and second sides, the at least one pocket being positioned on the cover such that the at least one pocket engages the sleep surface; and at least one insert configured to be received within the at least one pocket such that the at least one insert is positioned between the opposite first and second sides.

2. The article of bedding recited in claim 1, wherein the at least one pocket includes a first pocket and a second pocket, the at least one insert including a first insert and a second insert, the first insert being received within the first pocket and the second insert being received within the second pocket such that the inserts define two rails on the sleep surface.

3. The article of bedding recited in claim 1, wherein the cover is positioned over the sleep surface such that the sleep surface and a portion of the cover that engages the sleep surface are completely planar when the at least one insert is not received within the at least one pocket.

4. The article of bedding recited in claim 3, wherein the cover is made from a stretchable material.

5. The article of bedding recited in claim 4, wherein the stretchable material is spandex.

6. The article of bedding recited in claim 1, wherein the at least one pocket is sewn into a surface of the cover.

7. The article of bedding recited in claim 1, wherein the at least one pocket is sewn directly into a surface of the cover.

8. The article of bedding recited in claim 1, wherein the sleep surface is free of any recesses or cavities.

9. The article of bedding recited in claim 1, wherein the sleep surface is completely planar.

10. The article of bedding recited in claim 1, wherein the at least one pocket extends continuously between opposite first and second ends, the first end being positioned adjacent to the proximal edge and the second end being positioned adjacent to the distal edge.

11. The article of bedding recited in claim 1, wherein the at least one pocket includes a zipper to allow the at least one insert to be removed from and inserted into the at least one pocket.

12. The article of bedding recited in claim 1, wherein the cover is made from an elastic material.

13. An article of bedding, comprising:

a cover configured to be attached to a mattress having a sleep surface with opposite proximal and distal edges and opposite side edges each extending from the proximal edge to the distal edge; and at least one pocket coupled to the cover such that the cover is positioned on the at least one pocket and an entirety of the at least one pocket is positioned inwardly from the proximal and side edges, the at least one pocket being flush with the distal edge, the at least one pocket extending a length of the cover, the at least one pocket comprising opposite first and second sides, the at least one pocket directly engaging the cover such that the at least one pocket engages the sleep surface; and at least one insert configured to be received within the at least one pocket such that the at least one insert is positioned between the opposite first and second sides.

14. An article of bedding, comprising:

a cover configured to be attached to the mattress having a sleep surface with opposite proximal and distal edges and opposite side edges each extending from the proximal edge to the distal edge; and at least one pocket coupled to the cover such that the cover is positioned on the at least first or second pocket and an entirety of the at least one pocket is positioned inwardly from the proximal and side edges, the at least one pocket being flush with the distal edge, the at least one pocket extending a length of the cover, the at least one pocket comprising opposite first and second edges, the at least one pocket directly engaging the cover such that the at least one pocket directly engages the sleep surface; and at least one insert configured to be received within the at least one pocket such that the at least one insert is positioned between the opposite first and second edges.

15. An article of bedding, comprising:

a cover configured to be attached to the mattress with a sleep surface having opposite top and bottom edges and first and second side edges, each side edge extending from the top edge to the bottom edge;

a first pocket coupled to the cover such that the cover is positioned on the at least one pocket and an entirety of the first pocket is positioned inwardly from the opposite top edge and the first and second side edges, the first pocket being flush with the bottom edge, the first pocket extending a length of the cover and including opposite first and second sides and a second pocket coupled to the cover, the second pocket extending a length of the cover and including opposite first and second sides, the pockets each directly engaging the cover such that the first and second pockets each directly engage the sleep surface, each pocket extending continuously between opposite respective first and second ends, the first ends being positioned adjacent to the top edge of the cover, the second ends being positioned adjacent to the bottom edge of the cover and the first pocket extending adjacent to the first side edge of the cover and the second pocket extending adjacent to the second side edge of the cover; and a first insert and second insert, the first insert being received within the first pocket and the second insert being received within the second pocket such that the first and second inserts define two rails when positioned on a surface of the mattress.

* * * * *